US007017213B2

(12) United States Patent
Chisari

(10) Patent No.: US 7,017,213 B2
(45) Date of Patent: Mar. 28, 2006

(54) STOMACH SLEEPER

(76) Inventor: Joseph Chisari, 107 Main St., Fryeburg, ME (US) 04037

( * ) Notice: Subject to any disclaimer, the term of this patent is extended or adjusted under 35 U.S.C. 154(b) by 0 days.

(21) Appl. No.: 10/693,336

(22) Filed: Apr. 19, 2004

(65) Prior Publication Data

US 2005/0229314 A1 Oct. 20, 2005

(51) Int. Cl.
*A47C 20/08* (2006.01)

(52) U.S. Cl. ..... 5/632; 5/630

(58) Field of Classification Search ..... 5/630–632, 5/735; D6/601
See application file for complete search history.

(56) References Cited

U.S. PATENT DOCUMENTS

| | | | | | |
|---|---|---|---|---|---|
| 2,314,080 | A | * | 3/1943 | Dine et al. | 5/630 |
| 2,562,725 | A | * | 7/1951 | Leto et al. | 5/631 |
| 2,724,133 | A | * | 11/1955 | Sorrell | 441/127 |
| 3,811,140 | A | * | 5/1974 | Burpo | 5/632 |
| 3,828,377 | A | * | 8/1974 | Fary, Sr. | 5/632 |
| 4,171,549 | A | * | 10/1979 | Morrell et al. | 5/632 |
| 4,397,052 | A | * | 8/1983 | Lund, III | 5/632 |
| 4,635,306 | A | * | 1/1987 | Willey | 5/632 |
| 5,182,828 | A | * | 2/1993 | Alivizatos | 5/631 |
| 5,269,323 | A | * | 12/1993 | Krouskop | 5/632 |
| 5,448,790 | A | * | 9/1995 | Saro et al. | 5/657 |
| D409,038 | S | * | 5/1999 | Rojas et al. | D6/601 |
| 5,978,990 | A | * | 11/1999 | Akey | 5/632 |
| 6,009,873 | A | * | 1/2000 | Neviaser | 128/845 |
| D419,819 | S | * | 2/2000 | Bartoli | D6/601 |
| 6,047,419 | A | * | 4/2000 | Ferguson | 5/630 |
| 6,047,420 | A | * | 4/2000 | Priester et al. | 5/632 |
| D431,745 | S | * | 10/2000 | Jackson | D6/601 |
| 6,412,127 | B1 | * | 7/2002 | Cuddy | 5/632 |
| 6,886,201 | B1 | * | 5/2005 | Weiss-Lohrei | 5/631 |
| 2005/0005358 | A1 | * | 1/2005 | DuDonis | 5/632 |

* cited by examiner

*Primary Examiner*—Robert G. Santos
(74) *Attorney, Agent, or Firm*—Thomas L. Bohan; Patricia M. Mathers

(57) ABSTRACT

A sleeper-support device designed to minimize cervical rotation with respect to the torso for a person lying prone. The device includes a wedge-shaped head support that maintains the head in repose at an intermediate orientation between zero rotation and the traditional 90-degree rotation typical of the prone sleeper. The device also includes a wedge-shaped torso piece that constrains the torso from rotating in the direction that would increase the angle between the head and neck (the head-turn angle). The support this device provides prone sleepers allows them to sleep comfortably without incurring the back and cervical stress and strain commonly associated with sleeping in the prone position.

3 Claims, 2 Drawing Sheets

STOMACH SLEEPER

BACKGROUND OF THE INVENTION

1. Field of the Invention

The present invention relates to the field of human healthcare. More particularly, the present invention relates to efforts to relieve that cervical strain that occurs during sleep and results in stress to the entire spine. More particularly yet, the present invention is directed at such an end by supporting the neck of a person sleeping in the prone position. Most particularly, the present invention is a pillow with a shape that achieves this goal.

2. Prior Art

As chiropractors, osteopaths, and orthopedic surgeons well know, the human back in the great majority of individuals is subject to painful and often debilitating ailments, ailments that tend to increase in severity with age. It is also well known that many of these ailments arise from or are exacerbated by the activities engaged in by the sufferers. Although many of these activities are amenable to change so as to improve the health of the back, one of them is quite resistant to change—the "activity" of sleep. The manner is which the body is unconsciously arrayed during the hours that an individual is asleep can have immense influence on the back pain and infirmities experienced while he is awake.

As a category, the type of sleep that can contribute most strongly to spinal problems is prone sleep, that is, sleeping on one's stomach. Although the sufferers realize the harm that prone sleep causes, since they can feel it every morning upon arising, many people find it difficult to fall asleep in other positions. This means that they have to choose between restless, and even sleepless, nights, with the difficulties attendant thereto, and good sleep followed by a back that leaves them in pain all day. Consequently, there is a great need, by those who insist on prone sleep, for measures that will permit that sleep position while preventing the spinal stresses associated with it.

One aspect of prone sleep on a mattress that contributes to back problems is the tendency of the body to take on a "swayback" configuration, to the detriment of vertebral interactions. For most people, swayback can be minimized by experimenting with mattresses and other sleep surfaces until one is found that adequately supports the midriff so as to leave the mid-back in a more healthful alignment.

Not so easy to remedy is the problem arising from the neck twist that accompanies prone sleep. Unless one makes an arrangement, such as sleeping on a mattress with a ventilated, face-shaped hole in the mattress at the appropriate location, it is quite uncomfortable to lie with the face downward. This means that the head must be turned to one side or the other. This in turn involves rotation of the cervical spine which causes stress to be distributed throughout the entire spine. In discussing the problem, one tends to picture the twist arising because of the turning of the head while the torso remains fixed. However, it is also possible for the twist to increase or decrease because the torso twists while the head remains in a fixed orientation. Although one refers to the turning of the head, therefore, it should be recognized that it is the twist-angle between the head and torso that must be addressed, regardless of how it arises. It will do no good, for example, to hold the head in a fixed, comfortable position, only to have the twist angle increase to a damaging degree because of the torso turning while the subject is asleep.

In most sleeping configurations, the prone sleeper will have his or her head turned by 90 degrees from its straight-ahead orientation. As a measure of the stress that this places on the neck, most people are aware that once childhood is past it is almost impossible to turn the head this far in both directions, and that this is certainly true if there is not the assist provided by the body's inertia and the mattress surface. The strain and stress placed on the neck by sleeping with this 90-degree rotation is something that continues for many hours at a time, indeed, the length of a night's sleep for the prone sleeper. This cervical (neck) strain in turn causes hyperextension of the lumbar spine. Throughout the spine, the vertebral segments are far more adapted to compression and anterior-posterior motion than they are to rotation. (See, for example, BIOMECHANICS OF MUSCULOSKELETAL INJURY, by Gonza, E. R., and Harrington, I. L., Williams & Wilkins, publishers, Baltimore, 1982, p. 165.) Indeed, rotational stresses and strains can cause deformation and disruption of the posterior ligaments and joint capsules, resulting in dislocation. Furthermore, torsional (rotational) stresses such as those that may result from the head-turning normally associated with prone sleeping, can cause small circumferential tears in the disc such as appear at the onset of disc degenerations. As the lesion advances, these tears enlarge and coalesce, becoming radial tears that ultimately lead to disc herniation. In general, these rotation-caused lesions cause changes in the posterior joints and in the discs. (See, for example, CHIROPRACTIC MANAGEMENT OF SPINE RELATED DISORDERS, by Gatterman, M. I., Williams & Wilkins, publishers, Baltimore, 1990, pp. 35–36.)

In addition to the injuries described thus far, the neck twisting associated with traditional prone sleep can cause posterior-facet syndrome, which has been associated with chronic back pain. Etiological factors associated with this syndrome include hyperextension of the lumber spine. Posterior facet syndrome can cause a narrowing of the intervetebral disc space, resulting in nerve root compression, symptoms of which include as pain, motor weakness, muscle atrophy, and sensory loss (numbness and paraesthesia). (See, for example, *op. cit.*, pp. 42 and 161.)

Previous attempts to address the neck-twist stress associated with prone sleep have been directed at requiring the face of the sleeper to be directed toward the sleeping surface. See, for example, Priester III et al., U.S. Pat. No. 6,047,420 issued Apr. 11, 2000, which discloses a three-part array, one of which accepts the forehead of the prone sleeper and supports it sufficiently far from the sleep surface that that there remains a space between the sleeper's face and that surface, in general the top side of a mattress. There are two other components to the array of Priester III et al., consisting of supports to be place on each side of the sleeper to prevent him or her from rolling over. This latter feature follows because the device of Priester III et al. Is directed at persons who need, for one reason or another to sleep in a prone position even though that might not be their choice. Another approach to providing a "special arrangement" to allow the prone sleeper's face to be directed at the mattress is taught by Cuddy, U.S. Pat. No. 6,412,127 B1 issued Jul. 2, 2002. The device of Cuddy comprises in part a "doughnut" pillow akin to what is often used by persons lying prone while receiving a massage. Other attempts to configure the sleeping body for comfort or safety include the system taught by Burpo, U.S. Pat. No. 3,811,140, issued May 21, 1974, and the maternal positioning system of Ferguson, U.S. Pat. No. 6,047,419. Issued Apr. 11, 2000. Neither of these systems is appropriate for addressing the problem presently under discussion. For example, the system of Burpo is directed at rigidly aligning the body of a supine patient and therefore has no need to establish the relative orientation of the head and torso. Furthermore, its structure—consisting of two similar interconnected wedges, one running along each side of the patient's body, sloping down toward the body—is such that it cannot address the problem presently under discussion. On the other hand, the system of Ferguson is directed toward supporting a pregnant woman lying on her side. It has a single wedge-shaped body piece on which the mid-section of the woman's midsection is to be supported, and a contoured, inclined pillow section designed to accept the cheek of the woman tilted slightly upward. The pillow section is removably attachable to the body piece, the attachment interface consisting of two matching triangular surfaces. Even if the separate components of the Ferguson system are used in a configuration not taught by Ferguson, they will not serve the purpose being address by the present invention. Although it is possible and even comfortable to rest one's cheek on the Ferguson pillow piece if one is lying on one's side this is not the case if one is lying on one's stomach.

Therefore, what is needed is a device or method that will allow the person who, from preference, habit, or necessity, sleeps in the prone position, to do so without enduring the spinal stress associated with the head being twisted with respect to the torso through the angle usually associated with this sleep position. What is further needed is such a device or method that does not require the sleeper's face to be directed straight down toward the surface on which he or she is sleeping.

SUMMARY OF THE INVENTION

It is an object of the present invention to permit a person to sleep in the prone position without having to turn his or her head through the angle, approximately, 90 degrees, traditionally required by this sleep position. It is a further object of the invention to accomplish such a result without requiring the sleeper to sleep with his or her face directed straight downward toward the mattress or at any angle approximating this position.

With the orientation of the head defined by the angle through which it is rotated about the neck from its normal straight-ahead position, the present invention achieves the objects set out above by supporting the sleeper's head at an angle intermediate between zero degrees and 90 degrees. The 90-degree orientation corresponds to the traditional prone-sleep configuration and is the source of the back and neck pathology associated with prone sleeping. In short, the invention achieves its goal not by eliminating the head turning of the sleeper but by limiting the angle through which the head is permitted to turn. The invention does this through a plurality of wedge-shaped elements designed to be interposed between the prone sleeper and the sleep surface. These elements include in particular a wedge-shaped Head Piece that, in use, is oriented so that its thickness varies as one moves transversely across the bed. With this Head Piece interposed between the head of the sleeper and the sleep surface, the sleeper's head can then be supported comfortably through the sleep period if the sleeper faces toward the thinner edge of the Head Piece. That is, the sleeper's face is directed away from the direction in which the thickness (height) of the Head Piece increases, and in this manner, the orientation of the sleeper's head is maintained at an angle approximately equal to the wedge angle of the Head Piece. (Although the invention will be discussed terms of sleep on a mattress in a bed, this is not intended to limit the application envisioned for the invention. Indeed, it should be easily seen that the invention will function on essentially any sleep surface.)

The Head Piece supports the sleeper's head in such a way that the angle through which the head must turn with respect to the mattress is limited by the wedge angle of the Head Piece. For example, if the wedge angle of the Head Piece is 45 degrees, the angle through which the head must be turned as the sleeper lies prone on the mattress is approximately 45 degrees. If the wedge angle is 30 degrees, then the angle through which the head must be turned will be approximately 60 degrees, and so on. More generally, the angle through which the head must turn for prone sleep to occur when the present invention is in use will be approximately equal to the complement of the wedge angle of the Head Piece.

It is not sufficient, in terms of preventing pathology-inducing head-turn angles, simply to define the angle of the head with respect to the sleep surface, since with the head constrained in the manner just described, the head-turn angle will still be increased, possibly to an injurious degree, if the sleeper's torso attempts to turn over during the sleep period in the direction that increases the head-turn angle. Consequently, in addition to holding the head at a fixed, benign angle with respect to the mattress, the present invention also constrains the sleeper's torso from turning in a direction injurious to the neck. There are a number of ways to achieve this constraint. In the Preferred Embodiment of the intention, a second wedged element is used, one that extends along the length of the torso on one side, with the thickness of this element increasing in the opposite transverse direction from that in which the Head Piece increases in thickness when the two pieces are deployed properly on the sleeping surface. Each of the pieces can be characterized as having a longitudinal direction and a transverse direction. Indeed each can be characterized as a right cylinder, having a longitudinal axis and a wedge-shaped cross-section perpendicular its longitudinal axis. They can therefore be referred to as cylinders.

In summary, the present invention relies on specially shaped support surfaces that limit the independent rotation of the prone sleeper's head and torso, while permitting a head-turn angle that is comfortable and, more importantly, an angle that does not exert the spine-injuring stress produced by the angles traditionally associated with prone sleep.

DETAILED DESCRIPTION OF THE PREFERRED EMBODIMENT

Figure 1:
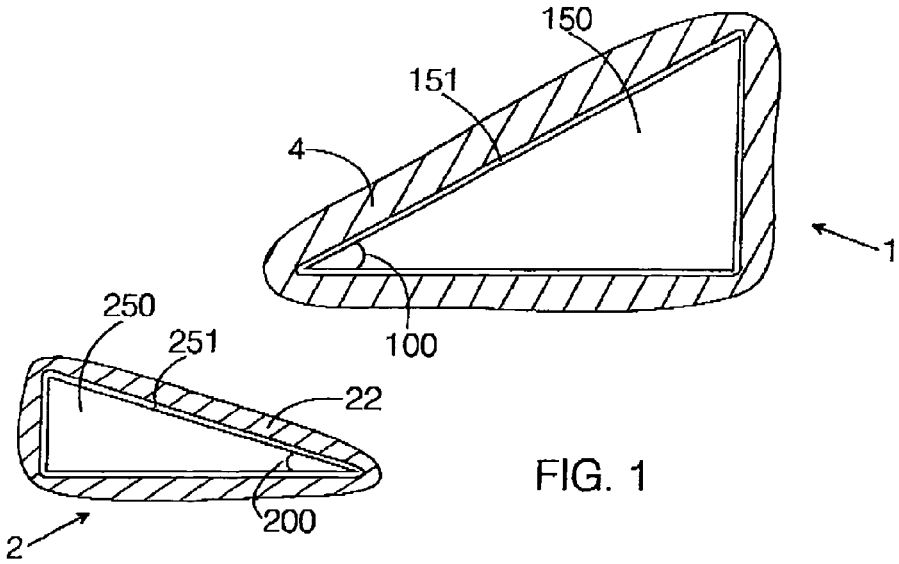
FIG. 1 depicts cutaways of the head piece and torso piece of the Preferred Embodiment of the invention.

The Preferred Embodiment of the invention has a single head piece 1 and a single torso piece 2, both as depicted in the cutaway drawings of FIG. 1.

Figure 2:
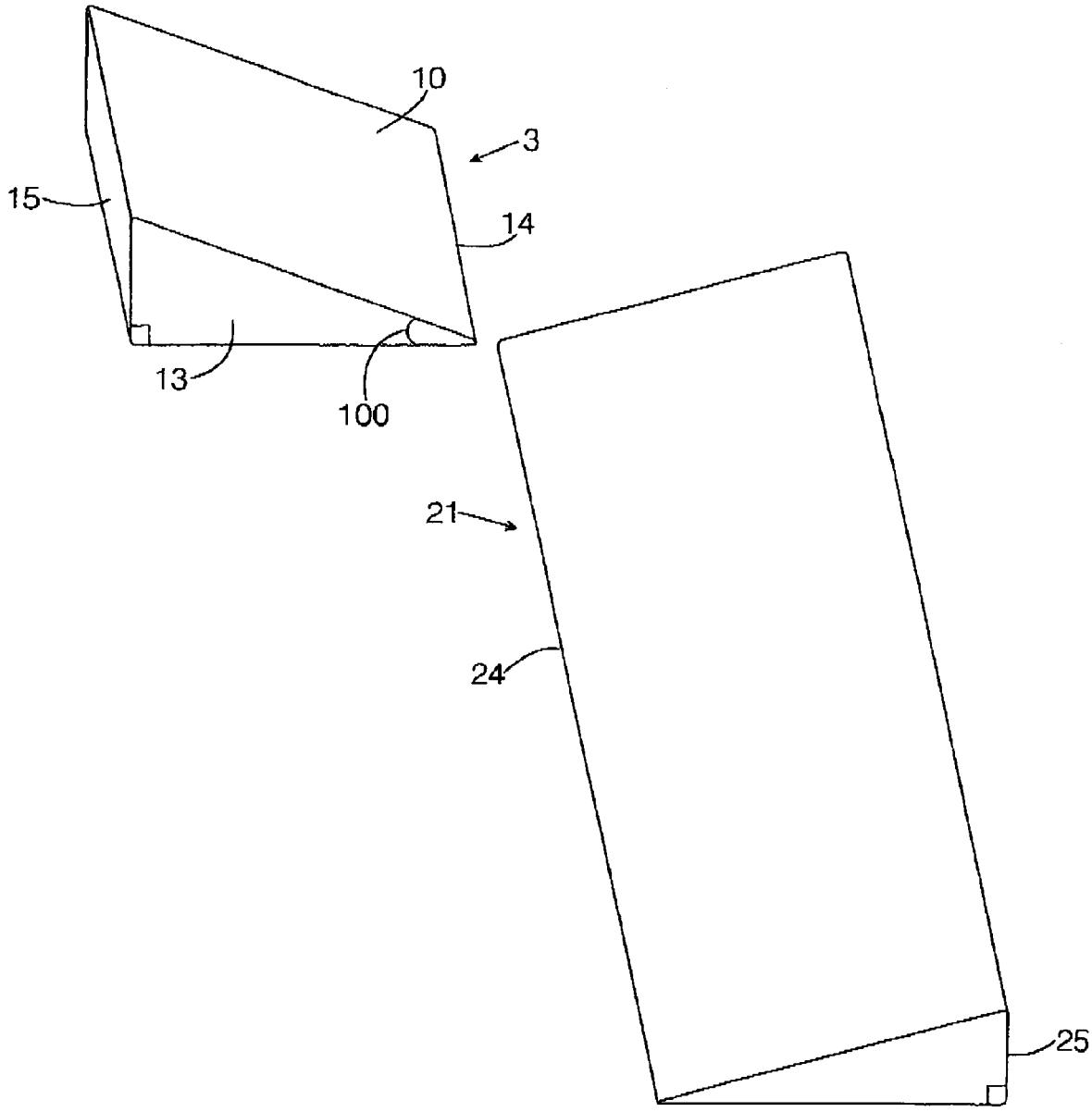
FIG. 2 is a perspective depiction of the head wedge and torso wedge of the Preferred Embodiment deployed in the configuration they would have when in use on a sleep surface.

As shown in FIG. 1, the head piece 1 is made up of a head wedge 3 and a head pillow 4, adapted so that the head wedge 3 can be removably inserted in the head pillow 4. As illustrated collectively in FIG. 1, FIG. 2, and FIG. 3, the head wedge 3 has an upper head-wedge surface 10, a lower head-wedge surface 11, a head-wedge top 12, a head-wedge bottom 13, a thin head-edge 14, and a thick head-edge 15. The head wedge 3 is primarily characterized by a head-wedge angle 100. Said head wedge 3 is constructed so as to be resistant to shape changes. In the Preferred Embodiment, it is made up of a wooden head block 150 covered with a head-block covering 151 consisting of thin flannel material. The wood of the head block 150 provides the rigidity and strength needed to maintain the wedge shape and the flannel of the head-block covering 151 provides a smooth, non-snagging surface enabling the head wedge 3 to be easily slid into and out of the head pillow 4.

The torso piece 2 is very similar to the head piece 1. It consists of a torso wedge 21 and a torso pillow 22, where the torso wedge 21 is characterized by a torso-wedge angle 200 and, in the Preferred Embodiment consists of a wooden torso block 250 and a flannel torso-block covering 251. The torso wedge 21 has a thin torso-edge 24, a thick torso-edge 251, and an upper torso-wedge surface 26.

The head pillow 4 is basically a normal pillow such as is commonly used in association with sleeping in a bed. It is intended to provide a comfortable surface for a prone sleeper 300, cushioning contact between a cheek 301 and the upper head-wedge surface 10. The head pillow 4 is depicted in FIG. 1 in the unloaded condition. Although in this condition, it appears to obscure the ramped surface that the present invention requires the sleeper 300 to rest upon, when the sleeper 300 is actually lying on the head piece 1 the head pillow 4 compresses so that the supporting surface is basically the upper head-wedge surface 10. In addition to providing cushioning for the cheek 301, the presence of the head pillow 4 ensures that a sleeper's head 302 has sufficient purchase that the head 302 does not slip down the ramped surface that is the essence of the invention.

Figure 3:
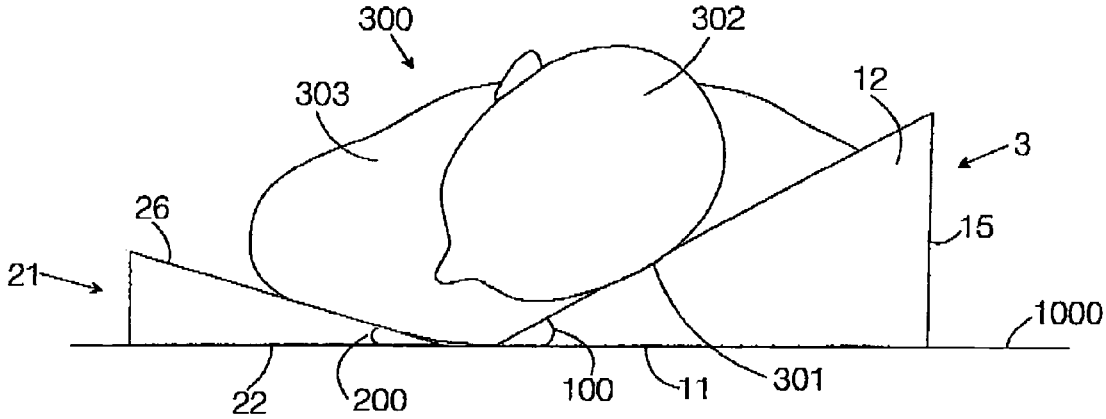
FIG. 3 is a stylized orthographic depiction of a prone sleeper's head supported by the head wedge of FIG. 2 and the sleeper's torso constrained by the torso wedge from rotation that would increase the head-turn angle.

Since, in use, the head pillow 4 will compress so as to modify only slightly the ramped surface that the head wedge 3 presents, it is reasonable for instructional purposes to illustrate the sleeper 300 lying directly on the head wedge 3 and the torso wedge 21, as is done in FIG. 3.

In the Preferred Embodiment, the head piece 1 has a transverse dimension (width) of approximately ten inches, and is roughly co-extensive with the head wedge 3, as shown in FIG. 1. Said head wedge 3 will have a thickness of approximately 5.8 inches at said thick head-edge 15 and negligible thickness at said thin head-edge 14. Treating said head pillow 4 as having little effect on the shape of the surface on which the sleeper lays his or her head, the sleeper 300 is shown in FIG. 3 with the head 302 supported directly by the head wedge 3 and a torso 303 constrained against rotation by the torso wedge 21. The stated dimensions will result in the head-wedge angle 100 being approximately 30 degrees [$\tan^{-1}$ (5.8/10)]. Presuming the torso 303 to be lying flat on the semi-rigid sleeping surface 1000, this results in a head-turn angle of 60 degrees. If this proves to be stressful to the prone sleeper, a smaller head-turn angle can be achieved by increasing the magnitude of the head-wedge angle 100. More generally, where the thickness of the head wedge 3 is H at the thick head-edge 15 and the transverse width of the head wedge 3 is W, the head-wedge angle 100 will be $\tan^{-1}$ (H/W).

The torso piece 2 is oblong. In the Preferred Embodiment, it extends approximately two feet in the longitudinal direction of the bed, presumed to be the context of the sleeping surface 1000 and about eight inches in the transverse direction. The thickness variation in said torso piece is across the narrow dimension, and, when deployed said torso piece 2 is oriented so that its long dimension aligns with the long dimension of the bed. As a result, the thickness of said torso piece 2 varies transversely across the bed. When it is deployed along with said head piece 1, as shown in FIG. 1, the thickness of said torso piece 2 varies in the opposite sense from the thickness variation of said head piece 1. Therefore, in a sense, the prone sleeper is located in a valley defined by the two wedges. For a prone sleeper lying on the configuration shown in FIG. 1, said head piece 1 will resist a left-to-right turning of the head, while providing a comfortable support surface for the head. Similarly, said torso piece 2 will prevent the sleeper's torso from engaging in rotation in the direction that would bring the sleeper's left shoulder deeper into the mattress.

As can be seen, the torso piece 2 of the Preferred Embodiment is the same as the head piece 1 except for some dimensional differences. It is intended to be wedged beneath one edge of the torso 303 of the sleeper 300, and to have sufficient length parallel to the bed that the thin torso edge 24 extends along the entire length of the torso 303. So that the torso piece 2 can serve this purpose, torso-wedge angle 200 is considerably less than the head-wedge angle 100. Because of the different functions played by the torso piece 2 and the head piece 1, the magnitude of the torso-wedge angle 200 is not as important as that of the head-wedge angle 100. It simply has to be small enough so that the torso piece 2 can fit comfortably under one edge of the torso 303, but not so small that it fails to constrain the torso 303 from rolling so as to increase the head-turn angle of the sleeper 300.

FIG. 3 shows the sleeper 300 with the head 302 turned in a particular direction with respect to the torso 303. However, the user of the Preferred Embodiment of the invention is not limited to one direction or the other. By flipping the assembly consisting of the torso piece 2 and the head piece 1 about a longitudinal axis 1000, the invention which had supported the head 302 turned to one side will equally well support it when it is turned to the other side.

Also consistent with the Preferred Embodiment is a set of pieces similar in shape to the head piece 1 differing only in the head-wedge angle 100. This would allow the invention to protect, seriatim, a number of persons who prefer to sleep in the prone position, but have varying threshold head-turn angles.

In general, there are many other variations on the Preferred Embodiment and indeed other embodiments entirely of the invention herein described. The detailed description of the Preferred Embodiment is provided for illustrative purposes only and is not meant to imply any limitations on the scope of the present invention.

The invention claimed is:

1. A sleep-support system for supporting a person sleeping prone on a sleep surface, said sleep-support system comprising:

a torso piece and a head-piece;

wherein said head-piece has a head-piece wedge shape formed by a flat base and a head-support surface having a transverse slope that is determined by a head-piece wedge angle, said head-support surface having a high end and a low end, and wherein said head-piece includes a head block made of a rigid material and a head-piece pillow cover that covers at least said head-support surface with a compressible cushioning material;

wherein said head-piece wedge angle is selected to support a head of said person at a slight angle relative to said mattress so as to provide comfort while minimizing vertebral stress on said person;

wherein said torso piece has a torso-piece wedge shape formed by a flat base and a torso-support surface having a transverse slope that is determined by a torso-piece wedge angle, said torso-support surface having a high end and a low end, said high end of said head-support surface being a height that is at least twice the height of the high end of said torso-support surface; and wherein said torso piece has a torso-piece length dimension and said head piece has a head-piece length dimension and wherein said torso-piece length dimension is sufficiently long to support a torso of said person and to prevent said torso from rotating, and said head-piece length dimension is sufficiently long to support a head of said person, without supporting said torso of said person.

2. A sleep-support system for supporting a person sleeping prone on a sleep surface, said sleep-support system comprising:

a torso piece and a head piece;

wherein said head-piece has a head-piece wedge shape formed by a flat base and a head-support surface having a transverse slope that is determined by a head-piece wedge angle, said head-support surface having a high end and a low end;

wherein said head-piece wedge angle is selected to support a head of said person at a slight angle relative to said mattress so as to provide comfort while minimizing vertebral stress on said person;

wherein said torso piece has a torso-piece wedge shape formed by a flat base and a torso-support surface having a transverse slope that is determined by a torso-piece wedge angle, said torso-support surface having a high end and a low end, said high end of said head-support surface being a height that is at least twice the height of the high end of said torso-support surface; and wherein said torso piece has a torso-piece length dimension and said head piece has a head-piece length dimension and wherein said torso-piece length dimension is sufficiently long to support a torso of said person and to prevent said torso from rotating, and said head-piece length dimension is sufficiently long to support a head of said person, without supporting said torso of said person, and wherein said torso-piece includes a torso block made of a rigid material and a torso-piece pillow cover that covers at least said torso-support surface with a compressible cushioning material.

3. Method for permitting the head of a prone sleeper on a bed surface having a longitudinal direction and transverse direction to be comfortably oriented without creating risky cervical-spinal stress, said method comprising the steps of (a) placing on said bed surface a cylindrical torso piece having a wedge-shaped cross section perpendicular to a torso-piece longitudinal axis, wherein said wedge-shaped cross section of said torso piece is characterized by a thin side and a thick side and by a torso wedge angle located at said thin side of said torso piece, and wherein said torso-piece longitudinal axis approximates in length a human torso;

(b) orienting said torso piece with said torso-piece longitudinal axis parallel to said longitudinal direction and said thin side of said torso piece adjacent to one side of said sleeper;

(c) placing a cylindrical head piece having a head-piece longitudinal axis and a wedge-shaped cross section perpendicular a head-piece longitudinal axis, wherein said wedge-shaped cross section of said head piece is characterized by a thin side and a thick side and by a head wedge angle located at said thin side of said torso piece, and wherein said head-piece longitudinal axis approximate in length a human head, orienting said head piece with said head-piece longitudinal axis parallel to said longitudinal direction with said thin side of said head piece facing said thin side of said torso piece;

(d) slipping said head piece upwards with respect to said sleeper and then between said bed surface and said head of said sleeper so that said head of said sleeper fully supported by said head piece while facing said thin side of said head piece.

* * * * *